US005732482A

United States Patent [19]

Remington et al.

[11] Patent Number: 5,732,482

[45] Date of Patent: Mar. 31, 1998

[54] RETRACTABLE SPIKE SYSTEM FOR SHOES

[75] Inventors: Mark D. Remington, Allegan; David H. Hodge, Hopkins; Ronald G. Schafer, Shelbyville, all of Mich.

[73] Assignee: Retractable Spike System, L.L.C., Allegan, Mich.

[21] Appl. No.: 565,892

[22] Filed: Dec. 1, 1995

Related U.S. Application Data

[60] Provisional application No. 60/004,172 Sep. 22, 1995.

[51] Int. Cl.[6] ..... A43C 15/14

[52] U.S. Cl. ..... 36/61; 36/134; 36/127

[58] Field of Search ..... 36/61, 134, 127

[56] References Cited

U.S. PATENT DOCUMENTS

| | | | |
|---|---|---|---|
| 1,361,078 | 12/1920 | Lynn | 36/61 |
| 3,793,751 | 2/1974 | Gordos . | |
| 4,146,979 | 4/1979 | Fabbrie . | |
| 4,375,729 | 3/1983 | Buchanen, III . | |
| 4,723,366 | 2/1988 | Hagger . | |
| 4,825,562 | 5/1989 | Chuang . | |
| 4,873,774 | 10/1989 | Lafever . | |
| 4,875,300 | 10/1989 | Kazz . | |
| 5,259,129 | 11/1993 | Deacon et al. . | |
| 5,289,647 | 3/1994 | Mercer . | |
| 5,337,494 | 8/1994 | Ricker . | |
| 5,351,422 | 10/1994 | Fitzgerald | 36/134 |
| 5,367,793 | 11/1994 | Deacon et al. . | |

FOREIGN PATENT DOCUMENTS

| | | | |
|---|---|---|---|
| 223 700 | 5/1987 | European Pat. Off. | 36/127 |

*Primary Examiner*—Paul T. Sewell
*Assistant Examiner*—Anthony Stashick
*Attorney, Agent, or Firm*—Price, Heneveld, Cooper, DeWitt & Litton

[57] ABSTRACT

A shoe is provided having one or more selectively extendable spikes mounted to the sole. The sole contains one or more spike housings, each retaining a spring-biased spike selectively movable between a retracted or extended position with respect to the housing as desired. A slide member disposed in the sole of the shoe is manually operated to extend or retract the spikes.

32 Claims, 3 Drawing Sheets

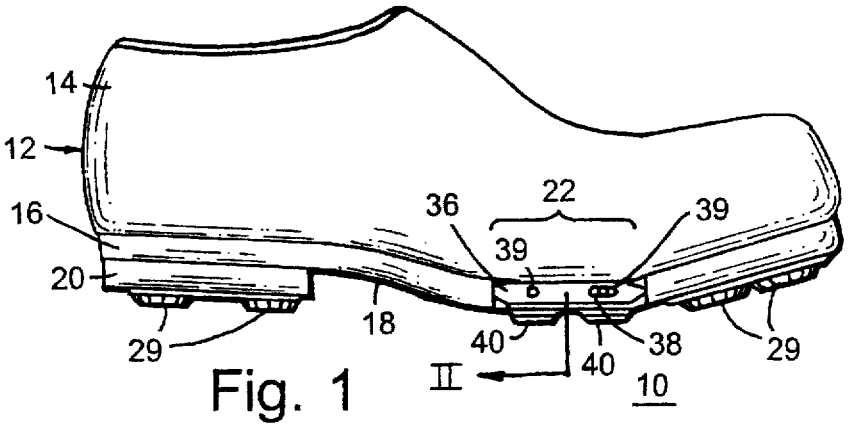
Fig. 1
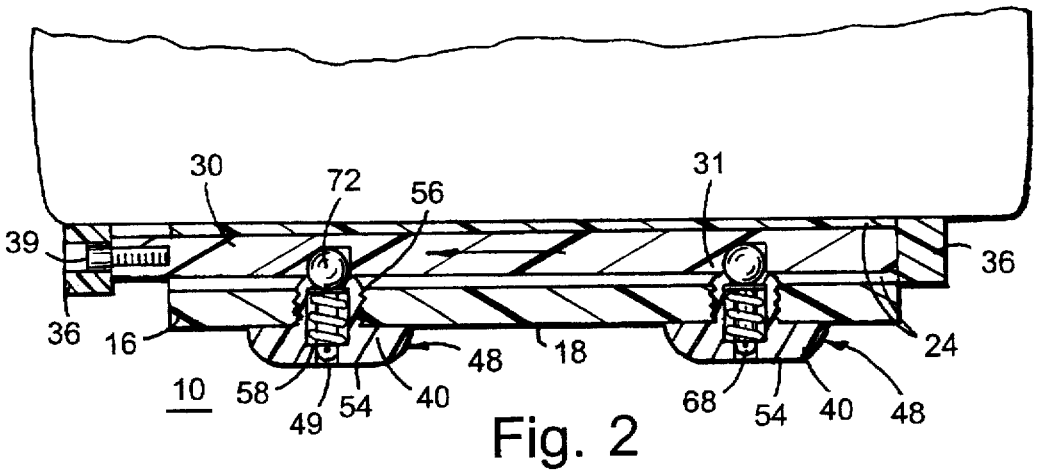
Fig. 2
Fig. 3
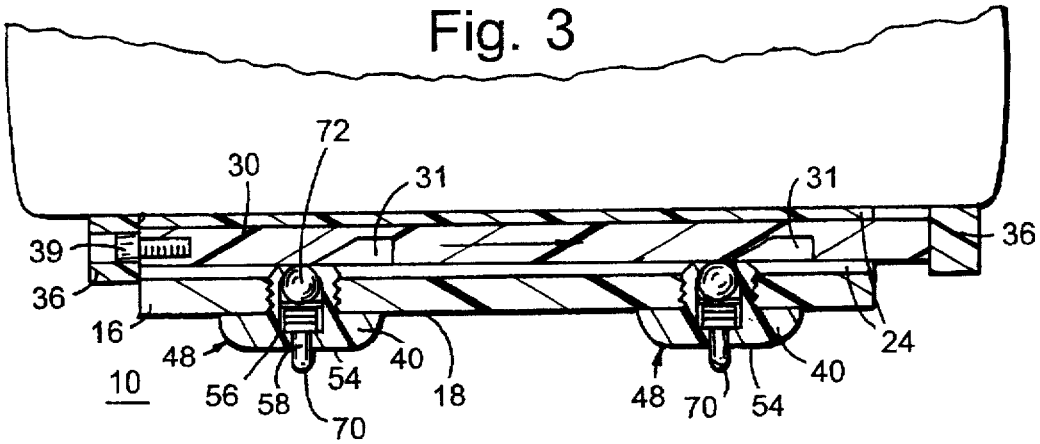

RETRACTABLE SPIKE SYSTEM FOR SHOES

CROSS-REFERENCE TO RELATED APPLICATION

This application claims priority under 35 U.S.C. §119(e) on United States Provisional Application No. 60/004,172 entitled RETRACTABLE SPIKE SYSTEM FOR SHOES filed Sep. 22, 1995 by Mark D. Remington.

BACKGROUND OF THE INVENTION

The present invention relates to a retractable spike system for shoes, preferably for use with golf shoes.

Golfers have worn shoes with metal spikes since at least as early as 1914. However, recent concern has developed over the damage that such spikes do to the golf course. Studies have shown that the average golfer wears 12 spikes on each shoe and takes an average of 56 steps on each green. That means that an 18-hole course averaging 200 rounds of golf a day withstands nearly 2.5 million spike marks a day, and more than 72.5 million a month. Golf shoes with metal spikes leave the putting surfaces torn and shredded, often resulting in missed putts by the golfer. Balls hit on metal-spiked grass are apt to vary in their course, especially as ball speed decreases. Many golf courses across the country have already banned shoes with metal spikes in an effort to improve and maintain the quality of the greens. These problems have become more pronounced recently because most of today's putting surfaces are grown from fragile bent grass rather than heartier poa annua, and constructed on a base of sand, which promotes drainage but is less sturdy than soil. The United States Golf Association has revised its recommendation for greens construction to 80% sand and 20% soil (previously 60–40). The extra sand helps greens "percolate" or drain, but fosters the pronounced spike marks that lead to the damaged and hard-to-play greens. Today's putting surfaces are also mowed shorter, so that they will be faster, and are more heavily trafficked because golfers are playing more. Also, the rules of golf do not allow golfers to tamp down or replace marks caused by metal spikes, which may be in the area between the ball and the hole, prior to putting.

Recently, an alternative to the metal spike, the so-called "soft spike," has been developed. These soft spikes are mainly shorter and flatter plastic swirls, or a combination of pyramids and nubs. Soft spikes and other spikeless alternatives are lighter and more comfortable than metal spikes. Spikeless shoes do not dig into the root structure of the grass, so they do not spread disease and poa annua seeds the way metal spikes do. They also do not compact soil, another frequent criticism of metal spikes. Spikeless or soft spike shoes provide much smoother greens, allowing the balls which are hit on such surfaces to roll "true," even as their speed decreases. In addition to the effect on greens, metal spikes can cause damage to wooden benches, tile floors, clubhouse carpeting, and cement walkways at golf courses. Spikeless shoes do not cause such damage.

One shortcoming of the spikeless shoe or soft spike shoe is that they often do not provide stable footing or traction in wet conditions. This situation can be dangerous—many golfers have already experienced serious falls while wearing the soft spike shoes. One solution to this problem is to modify a regular shoe so that traditional metal spikes are available only when needed (e.g., on a slippery slope, etc.), but which can also be effectively removed or displaced when their use is not needed or permitted (e.g., on the greens area of a golf course or a clubhouse floor, etc.).

Attempts have been made at providing a modified shoe device which allows for the retraction and extension of one or more spike members from the bottom of the shoe. For example, U.S. Pat. No. 4,375,729 to Buchanen, III relates to anti-skid spikes for use on shoes or boots, to provide firm footing on ice or snow. The spikes are situated in and vulcanized or otherwise secured to flexible recesses or dimples in the sole of the shoe, so that the spikes are normally in a retracted position. Buchanen, III's shoe, therefore, does not provide for the replacement of the spikes once they are worn out or damaged. If this occurs, the entire shoe becomes deficient or unusable, necessitating the need to purchase a brand new set of shoes. Furthermore, in Buchanen, III, the recesses or dimples which hold the spikes are made of a flexible material, and are therefore subject to possible cracking in cold weather or tearing upon engagement of the sliding cam member with the dimpled recesses.

Another example is found in U.S. Pat. No. 4,825,562 to Chuang, which also relates to shoes used for walking on snow or ice. Chuang's shoe requires the user to actually remove the shoe and rotate a knob beneath the insole which causes sets of nails to extend and retract from the bottom of the shoe. Further, neither Chuang nor Buchanen, III are aimed at eliminating damage to the greens area of a golf course, which has only recently become a concern due to the switch to fragile bent grass and the change in sand composition of the greens area.

A need has developed, therefore, for a shoe which not only can be used on sensitive walking areas, such as the greens area of a golf course, but which also can be used in areas where firm traction is necessary, such as a wet slope or hill. Furthermore, a need exists for a retractable spike golf shoe which has the capability to use both newly-developed "soft spikes" and, as needed, traditional metal spikes, which also allows for repair or replacement of either the soft spike or the metal spike when worn or damaged, and which uses durable rigid parts to provide a reliable operating mechanism and secure lock between extended and retracted positions to avoid having the mechanism slip out of one position into another. The system should be quickly and easily accessible, so that a golfer can readily activate the device without having to remove the shoe or the like.

SUMMARY OF THE INVENTION

In the present invention, a retractable spike system for shoes is provided which comprises one or more hollow tracks positioned within the sole of a shoe. Communicating with the track and extending downward therefrom out through the bottom of the shoe are one or more open-ended bores. A spring-biased retractable spike is housed within each open-ended bore so as to be vertically moveable therein, there being a ball member positioned above the spring-biased spike. A slide member is slidably positioned within each hollow track, and includes recesses which correspond to and align with the open-ended bores holding the retractable spikes. The recesses are configured to hold the ball member when the retractable spikes are in a first position, and to engage and displace the ball member, thereby causing the movement of the retractable spikes to a second position upon urging of the slide member.

In further aspects of the invention, the retractable spike is housed within a spike housing. The spike housing may be provided at its lower end with an apertured, disc-shaped flange member, which contacts the bottom of the sole and extends therefrom. The flange member may be provided with a plurality of traction nubs or ridges, to provide a simulated "soft spike". This arrangement provides a fixed spike out of which a retractable spike may extend and retract. Other regular "soft spikes" may be positioned at other locations about the bottom of the sole.

The retractable spike system of the present invention provides the wearer with the necessary traction to walk safely upon slippery areas, such as a wet slope or hill, by extending the retractable spikes, while at the same time allowing the wearer to walk on more sensitive areas, such as the greens area of a golf course or a hardwood floor, by retracting the spikes.

These and other features, advantages and objects of the present invention will be further understood and appreciated by those skilled in the art by reference to the following specification, claims and appended drawings.

BRIEF DESCRIPTION OF THE DRAWINGS

FIG. 1 is a side elevational view of a golf shoe including the retractable spike system of the present invention;

FIG. 2 is a cross-sectional view taken along line II of FIG. 1, showing the slide member in spike-retracted position;

FIG. 3 is the same cross-sectional view as shown in FIG. 2, showing the slide member in spikes-extended;position;

DETAILED DESCRIPTION OF PREFERRED EMBODIMENTS

Figure 4:
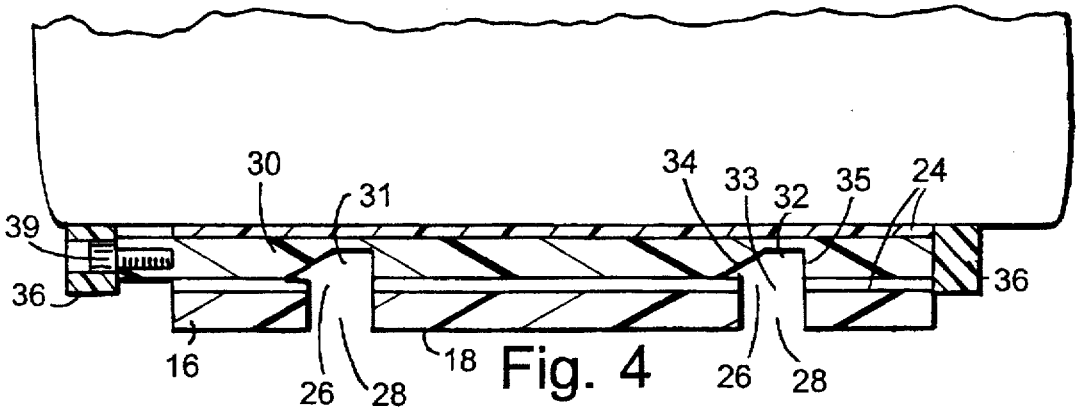
FIG. 4 is the same cross-sectional view as shown in FIG. 2, without the spike housing, retractable spike, spring, and ball member being shown.

For purposes of description herein, the terms "upper," "lower," "right," "left," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

In the preferred embodiment, a retractable spike system for shoes is provided, shown generally in FIGS. 1–10 and designated by the numeral 10. The illustrated retractable spike system 10 includes a shoe 12 having one or more spike housings 40, which house spring-biased retractable spike 58. Retractable spike system 10 allows a person wearing shoe 12, such as a golfer, to extend the retractable metal spikes when walking on certain areas where traction is necessary (e.g., a slippery slope, etc.), or to retract the spikes when walking on areas that may be sensitive to or damaged by pointed metal spikes (e.g., the greens area of a golf course, hardwood floors, carpeting, etc.). Retractable spike system 10 is easily accessible to a person wearing shoes fitted with system 10 and is easy to operate. System 10 also provides a firm lock between extended and retracted positions, such that it is not possible for the system to move between positions accidentally or without activation by the user. Additionally, system 10 is designed and configured such that it may be utilized in any type of shoe, including but not limited to athletic-type shoes, without detracting in any way from the shoe's aesthetic appearance.

Referring specifically to FIG. 1, retractable spike system 10 is shown in connection with golf shoe 12. Shoe 12, as depicted in the drawings, is a traditional golf shoe having a shoe upper portion 14, and a sole 16 with sole bottom 18 and heel portion 20 attached to upper portion 14. However, spike system 10 is readily adaptable for use with all types of shoes, and is in no way limited to golf shoes. Also, use of spike system 10 is not limited to traditional golf shoes such as that depicted in the drawings, i.e., golf shoes having a dress shoe-type heel and sole configuration. Rather, spike system 10 can be utilized in other types of golf shoes, such as "turf" shoes which have a flat bottom and no separately-defined heel portion. Such "turf" shoes often have a plastic or rubber sole having several hundred small nubs or projections thereon.

Figure 12:
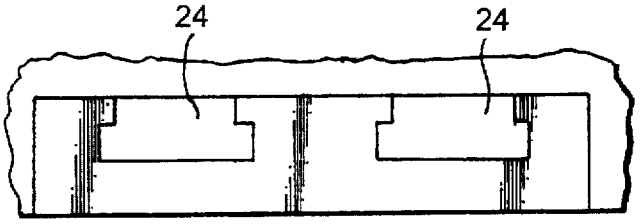
FIG. 12 is an enlarged, partial side elevational view of the golf shoe, showing the push bar and slide members removed to reveal the guide tracks.

As shown best in FIG. 12, sole 16 includes one or more hollow guide tracks 24. Guide tracks 24, which may be formed directly in sole 16 or which may be a separate member housed within a hollowed-out portion of sole 16, preferably extend laterally through sole 16 from one side of shoe 12 to the other, and are open on each end. FIG. 12 depicts shoe 12 with guide tracks 24, the remainder of spike system 10 not being depicted so as to clearly show the guide tracks 24. As shown in FIG. 4, guide tracks 24 each have one or more downwardly-extending openings or holes 26 in the bottom of the track to allow for communication of the guide track 24 with the rest of the system, as will be described in more detail below.

Any number of guide tracks 24 may be located in sole 16, at any desired position along sole 16. In the preferred embodiment, shoe 12 is equipped with two guide tracks 24, as shown in FIGS. 1, 4, 5, 9, and 10, which are positioned near the ball area 22 of shoe 12, corresponding to the ball area of a person's foot. This is normally adequate to provide the desired traction, when necessary, since most of a person's weight when walking, swinging a golf club, etc., will rest on the ball area. However, additional guide tracks 24 could be positioned within sole 16, including heel portion 20 if so desired.

Figure 5:
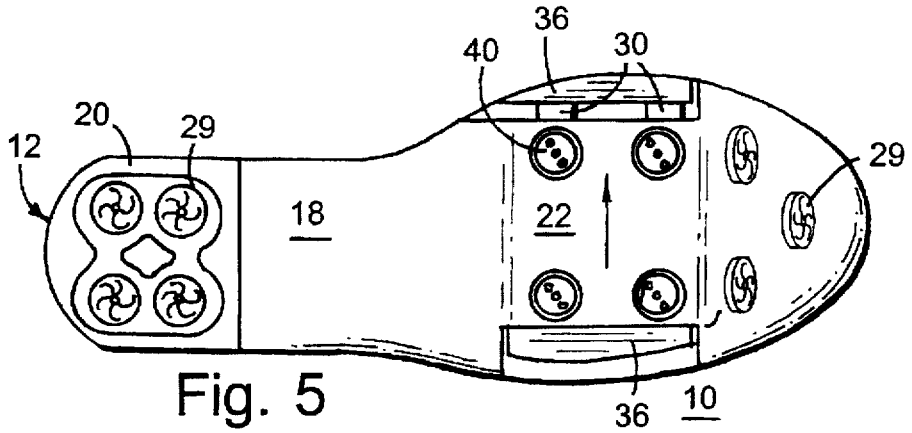
FIG. 5 is a bottom plan view of the shoe, shown with the push bar displaced to the top or inside edge of the shoe, for the spikes-retracted position.
Figure 6:
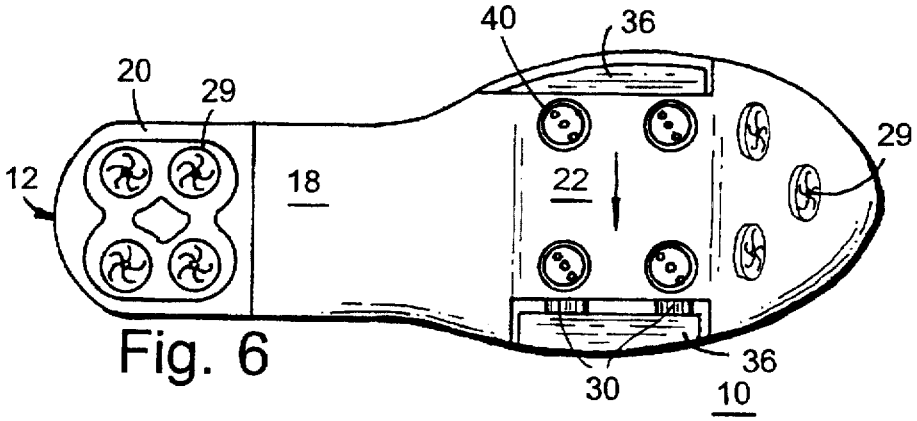
FIG. 6 is a bottom plan view of the shoe, shown with the push bar displaced to the bottom or outside edge of the shoe, for the spikes-extended position.

Sole 16 is provided with a plurality of open-ended bores 28, as shown in FIG. 4. Bores 28 are arranged in a predetermined fashion about bottom 18 of sole 16, in alignment with holes 26 in guide track 24. In this configuration, an open passageway exists which extends from hollow guide track 24 perpendicularly downward therefrom through holes 26 in guide track 24 which are aligned with bores 28, out through bottom 18 of sole 16. In the preferred embodiment as shown in FIGS. 5 and 6, two bores 28 (not shown) are provided along each guide track 24 (not shown), giving a total of four bores. Preferably, bores 28 include threaded plugs for threadably receiving the spike housings, 40 as will be described in more detail below.

Sole 16 may also be provided with additional bores and threaded plugs spaced at additional locations about the bottom 18 of sole 16. These bores are not open on both ends, but instead are open only to the bottom 18 of sole 16, and are designed for receiving traditional metal spikes or, more recently, plastic "soft spikes." In the preferred embodiment, a plurality of plastic "soft spikes" 29 are located near the toe area and heel area of the traditional golf shoe 12, as shown in FIGS. 5 and 6. Such "soft spikes" are more accepted at golf courses which are concerned with the damage that traditional metal spikes do, and they provide a modest amount of traction. However, because these "soft spikes" are made of a hard plastic material and have a generally flattened disc shape, it may be possible to slip and fall on a wet area or on a hilly area. Thus, by combining these "soft spikes" with a shoe having retractable metal spikes, a shoe is provided which allows the wearer to have secure traction when necessary, thereby decreasing the risk of slips and falls and resultant injuries, while at the same time eliminating the metal spikes when appropriate (via retraction), thereby reducing the damage to greens areas, club house floors, etc.

Spike system 10 further includes slide member 30, positioned in and slidably movable within each guide track 24. Slide member 30 is preferably constructed of a hard durable material, such as a rigid plastic material, and is slightly longer than the width of sole 16 so that a portion of slide member 30 is visible on either side, or both sides, of sole 16 when looking at the bottom of shoe 12. As shown in FIG. 5, slide member 30 will be visible on one side of sole 16 (inside edge of shoe as shown in FIG. 5) when system 10 is in a first position (e.g., spikes retracted), while being hidden on the opposite side of sole 16. When system 10 is activated by sliding slide member 30 to a second position (e.g., spikes extended), as in FIG. 6, slide member 30 will be visible on the opposite side (outside edge of shoe as shown in FIG. 6), while being hidden on the other side. It should be understood that slide member 30 need not be completely visible on one side while being completely hidden on the other side at all times. Rather, slide member 30 could be constructed in such a way that it is always visible on both sides of sole 16, with unequal lengths of slide member 30 being visible depending on which position slide member 30 is in at a particular time. Further, it is a matter of design choice as to which direction slide member 30 must be moved to retract and extend the spikes. In FIGS. 5 and 6, slide member 30 is shifted from the top or inside edge of shoe 12 (spikes retracted) to the bottom or outside edge of shoe 12 to extend the spikes. However, this arrangement could be reversed so that the extension is accomplished by moving slide member 30 from right (outside edge) to left (inside edge), and the arrangement shown in the drawings is not intended to be limiting in any way.

Figure 13:
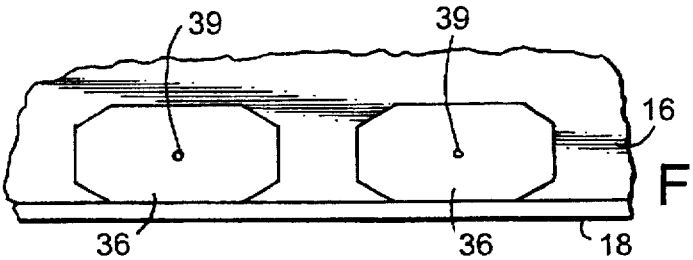
FIG. 13 is an enlarged, partial side elevational view of the golf shoe, showing two separate push bars, one for each slide member.

Each slide member 30 is activated by the wearer by pushing on slide member 30 to slide it from side to side. This is preferably accomplished by pressing on push bar 36, attached to each exposed end of slide member 30. As shown in FIG. 13, each slide member may have its own set of push bars 36. In the preferred embodiment, guide tracks 24 are joined by a single push bar 36 on either side of shoe 12, as shown in FIG. 1. This allows the wearer to extend (or retract) all of the retractable spikes at once with a single motion. In a preferred embodiment, push bar 36 is provided with at least one slot 38 at the point of attachment to one of guide tracks 24. Attachment to guide track 24 is accomplished by pin 39, attached to guide track 24 and slidably located within slot 38. This allows for the single push bar 36 to in effect "flex" due to the body weight of the wearer which normally occurs as the wearer walks in the shoes. Pin 39 will slide back and forth within slot 38, alleviating any potential stress on push bar 36.

Slide member 30 is further provided with one or more downwardly-facing recesses 31, as shown in FIG. 4. Recesses 31 are "downwardly-facing" in the sense that when slide member 30 is positioned within guide track 24, recesses 31 face downwardly towards bottom 18 of sole 16. Recesses 31 are located along slide member 30 at distances which allow recesses 31 to be aligned with openings 26 in guide track 24 and corresponding open-ended bores 28 in sole 16.

As shown best in FIG. 4, recesses 31 are generally trapezoidal in shape, in that top wall 32 is generally parallel to downwardly-facing opening 33, and angled wall 34 is not parallel to side wall 35. The exact shape of recess 31 is not critical, however, in order for spike system 10 to operate most effectively, it is preferred that recess 31 includes at least one angled wall 34, which slopes downwardly and outwardly away from top wall 32, so that the length of top wall 32 is smaller than the length of downwardly-facing opening 33. Side wall 35, opposite angled wall 34, is preferably vertical, i.e., perpendicular to top wall 32.

Disposed within each open-ended bore 28 is a spike housing 40. Spike housing 40 may be permanently affixed within bore 28. Preferably, housing 40 is removably inserted within bore 28, to allow for removal and/or replacement of the various components as necessary. Most preferably, housing 40 is provided with external threads for threadably inserting housing 40 within threaded plugs in open-ended bores 28, as shown in FIGS. 2 and 3.

Figure 7:
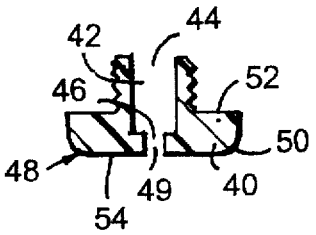
FIG. 7 is a sectional side view of one of the spike housings shown in FIG. 5, without the spring, retractable spike, and ball member being shown.

Spike housing 40 comprises a hollow cylinder 42 having an open upper end 44 and an open lower end 46, as shown in FIG. 7. When positioned within sole 16, spike housing 40 occupies open-ended bore 28 and can extend into openings 26 in guide track 24. Open upper end 44 of housing 40 communicates and is aligned with downwardly-extending opening 26 in guide track 24 and, in one configuration of system 10 (spikes retracted), also communicates and is aligned with recess 31 in slide member 30 (as shown in FIG. 2). Open lower end 46 communicates with bottom 18 of sole 16.

Figure 8:
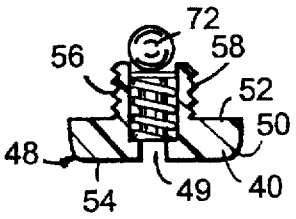
FIG. 8 is a sectional side view of one of the spike housings shown in FIG. 5, showing the spike, with accompanying spring and ball member, in the retracted position.
Figure 9:
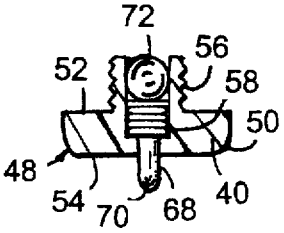
FIG. 9 is a sectional side view of one of the spike housings shown in FIG. 6, showing the spike, with accompanying spring and ball member, in the extended position.

Preferably, housing 40 is further provided at its open lower end 46 with flange member 48, as shown in FIGS. 7–9. Flange 48 comprises a relatively thin projecting rim or collar around cylinder 42, forming a disk-like structure, and preferably has rounded edges 50 leading from upper portion 52 to lower portion 54, as shown in FIG. 7. With aperture 49 at the lower end 46 of cylinder 42, flange 48 defines an apertured disk. Flange 48 is constructed of a rigid, durable material such as plastic or metal (aluminum). When spike housing 40 is positioned within open-ended bore 28, upper portion 52 of flange member 48 contacts bottom 18 of sole 16, and flange member 48 extends from bottom 18 of sole 16 so that when a person walks with the shoes in this embodiment, lower portion 54 of flange member 48 contacts the walking surface. In this way, flange member 48 acts much like the "soft spikes" located about the toe and heel portions of the shoe. To further simulate the look and feel of a "soft spike," lower portion 54 of flange member 48 may be provided with a plurality of small downwardly facing projections, traction ridges, or nubs 55 for increased traction in the ball area 22 of sole 16 when the spikes are in the retracted position. Essentially, such an embodiment provides a "spike-within-a-spike" configuration, one fixed disk-shaped soft spike (hereinafter "fixed spike") and the other being a retractable spike 58 (pointed metal spike movable) in and out of the fixed spike.

Figure 10:
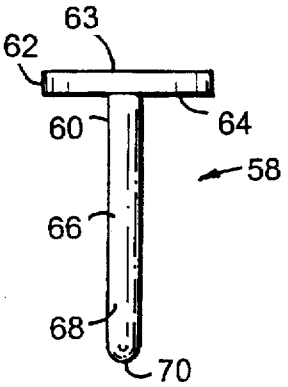
FIG. 10 is a side elevational view of the retractable spike of the present invention.
Figure 11:
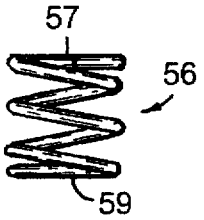
FIG. 11 is a side elevational view of the spring of the present invention.

Within hollow cylinder 42 of spike housing 40 is biasing member on spring 56. Spring 56 is preferably helical, but includes such things as a flexible pad or hydraulic means, etc., and is located generally between the open upper end 44 and open lower end 46 of spike housing 40. Positioned centrally within spring 56 is retractable spike 58. As shown in FIG. 10, retractable spike 58 includes an upper or first end 60 which includes a flat base 62, a shaft 66, and a lower or second end 68 having a pointed tip 70 thereon. Flat base 62 has a top surface 63 and a bottom surface 64, and is positioned within spring 56 such that the top end 57 of spring 56 contacts bottom surface 64 of flat base 62, thereby supporting retractable spike 58.

Spring 56 biases spike 58 upwardly so that spike 58 is in a spike-retracted position, as shown in FIG. 8. Therefore, spring 56 must have a diameter that is less than the diameter of flat base 62, so as to enable spring 56 to bias and support spike 58 upwardly. In the retracted position, spring 56 is in its natural, uncompressed state, and spike 58 is of a length such that tip 70 does not protrude from aperture 49 in spike housing 40.

A ball member 72 is positioned adjacent top surface 63 of flat base 62 of spike 58. Ball member 72 is constructed of a rigid, durable material, such as plastic or metal (e.g., steel), and is sized such that it fits within recess 31 in slide member 30 and has a diameter which is smaller than the diameter of hollow cylinder 42 to allow ball member 72 to fit within spike housing 40. When slide member 30 is activated, ball member 72 is forced down upon flat base 62, causing spring 56 to compress and lower end 68 of spike 58 to extend outwardly through aperture 49 in spike housing 40, placing system 10 in a spikes-extended position, as shown in FIG. 9.

More specifically, the spikes-retracted position is shown in FIG. 2. Ball member 72 is positioned within recess 31 of slide member 30 and rests atop flat base 62 of spike 58, which is biased upwardly by spring 56. Lower end 68 of spike 58 remains within spike housing 40, pointed tip 70 being positioned at or near aperture 49, such that spike 58 does protrude from lower portion 54 of flange member 48. Spike 58 will remain in this retracted position until system 10 is activated by the wearer.

Extension of spike 58 is accomplished by sliding slide member 30 laterally such that angled wall 34 of recess 31 contacts ball member 72. The slope of angled wall 34, combined with the lateral force exerted on slide member 30 and the spherical shape of ball member 72, causes ball member 72 to be displaced downwardly against flat base 62 of spike 58, thereby expelling ball member 72 from recess 31. Slide member 30 is moved laterally until ball member 72 is trapped completely below slide member 30. In this spikes-extended position, ball member 72 will actually be located within hollow cylinder 42 of spike housing 40. As shown in FIG. 3, this movement of ball member 72 from recess 31 into spike housing 40 causes flat base 62 of spike 58 to move downwardly, compressing spring 56, resulting in the extension of pointed tip 70 of spike 58 downwardly and outwardly through aperture 49 in flange member 48. Spike 58 will remain in this extended position until the system is again activated by the wearer. Slide member 30 firmly holds ball member 72 down within spike housing 40. System 10 thereby provides a firm lock between extended and retracted positions. Virtually the only way for the system to move from one position to another is by the wearer activating the system. Once extended, retraction of spike 58 is accomplished by urging slide member 30 in the opposite direction of that which accomplished extension. Recess 31 will once again be positioned over hollow cylinder 42 of spike housing 40, and spring 56 will decompress, forcing ball member 72 and spike 58 upwardly so that ball member 72 rests in recess 31.

It should be understood that arranging spike 58 so that its shaft 66 is positioned down through the inner coils of spring 56 and so that its flat base 62 rests on top end 57 of spring 56 is merely the preferred embodiment. It may be possible to rearrange these two components by placing spike 58 below spring 56, such that top end 57 of spring 56 contacts ball member 72 and bottom end 59 of spring 56 contacts top surface 63 of flat base 62 of spike 58. In this alternate embodiment, shaft 66 of spike 58 would have to be much shorter in length than in the preferred embodiment, so that spike 58 would not protrude from lower portion 54 of flange member 48 when in the spikes-retracted position. Also, an additional spring or other biasing means would have to be present below bottom surface 64 of flat base 62 to bias spring 56 upwardly from open lower end 46 of spike housing 40.

System 10 is readily activated by the wearer by pushing on push bar 36 laterally in the appropriate direction for retracting or extending the spikes, whichever position is desired. This can be accomplished in several ways, including simply reaching down and pushing on push bar 36 with one's hand or fingers, tapping push bar 36 with the head or grip of a golf club which thereby eliminates the need to bend over, or by contacting push bar 36 with a stationary object such as a curb or the like. Preferably, push bar 36 will extend slightly outward from the edge of shoe 12, so as to be easily accessible to the wearer. Most preferably, push bar 36 extends outwardly in this manner only from one edge when in the first position (e.g., spikes retracted) and then only from the opposite edge when in the second position (e.g., spikes extended). This minimizes the visibility of system 10. System 10 can be configured in such a way that push bar 36 will always remain "hidden" underneath shoe 12, i.e., so that push bar 36 does not extend outwardly from either edge of shoe 12 at any time, in any position. However, this configuration is not as easily accessible to the wearer, as it becomes necessary to reach underneath the shoe and locate push bar 36 to activate system 10. In any embodiment, it is preferable to contour the shapes of push bars 36 so that their shapes simulate the shape of the respective outer edges of shoe 12, as shown in FIGS. 5 and 6.

In order to protect push bar 36 and the remainder of system 10, a flexible wrap or cover may be provided which extends from the side of shoe 12 over push bar 36 and is attached to sole 16. Such cover may be formed from a material such as polypropylene or the like. This wrap or "bubble" serves to protect system 10 from contamination due to rain, dirt, or other debris with which the shoe may come into contact. The "bubble" should be sufficiently flexible, however, so that the wearer is still able to activate system 10 by pressing on push bar 36, which is surrounded entirely by the covering material.

In another embodiment, slide member 30 may be spring-mounted within guide track 24. In this embodiment, guide track 24 is closed on one end and open on the opposite end, so that slide member 30 extends only from the one open end. A spring is mounted such that guide track 24 moves laterally within guide track 24 in much the same fashion as a retractable ball-point pen. Push bar 36 is pressed once to compress the spring which biases slide member 30, thereby placing the system in a first position (e.g., spikes extended), and then pressed a second time to release the spring which biases slide member 30, thereby placing the system in a second position (e.g., spikes retracted).

The above description is considered that of the preferred embodiments only. Modifications of the invention will occur to those skilled in the art and to those who make or use the invention. Therefore, it is understood that the embodiments shown in the drawings and described above are merely for illustrative purposes and are not intended to limit the scope of the invention, which is defined by the following claims as interpreted according to the principles of patent law, including the doctrine of equivalents.

The embodiments of the invention in which an exclusive property or privilege is claimed are defined as follows:

1. A shoe comprising:

a sole having a bottom at least one hollow track extending through said sole, and at least one open-ended bore extending from said hollow track through said bottom of said sole;

a retractable spike having a first end and a second end, said retractable spike being positioned within said bore and translatable between an extended position wherein said first end protrudes from said bottom of said sole and a retracted position wherein said first end does not protrude from said bottom of said sole;

a biasing member engaging said retractable spike and resiliently urging said retractable spike toward said retracted position;

a slide member slidably mounted in said hollow track having at least one surface oriented toward said bore when in said retracted position, said surface configured to urge said retractable spike downwardly to said extended position; and a ball member interconnecting said retractable spike with said at least one surface on said slide member, so that said surface contacts said ball member and displaces said ball member toward said retractable spike, causing a corresponding displacement of said retractable spike.

2. The shoe of claim 1, wherein said hollow track extends laterally through said sole from one side of said shoe to the other side of said shoe.

3. The shoe of claim 2, wherein said shoe includes a fixed spike attached to said sole, having centrally disposed therein said retractable spike, and wherein said retractable spike is slidably mounted in said fixed spike so as to extend and retract through an aperture in said fixed spike.

4. The shoe of claim 3, further comprising a spike housing secured to said sole through said bore, said spike housing comprising a hollow cylinder in which said retractable spike is received.

5. The shoe of claim 4, further comprising a rigid guide track extending through said hollow track.

6. The shoe of claim 5, wherein said biasing member includes a spring.

7. The shoe of claim 6, wherein said retractable spike includes a head at said first end, and said spring includes a top portion, said retractable spike being positioned centrally through said spring so that said head rests on said top portion of said spring, said ball member resting adjacent said head opposite said spring.

8. The shoe of claim 7, wherein said second end of said retractable spike is provided with a pointed tip.

9. The shoe of claim 8, wherein said at least one surface includes an angled surface for engaging and displacing said ball member upon movement of said slide member to accomplish extension of said retractable spike.

10. The shoe of claim 9 wherein said slide member is equipped with a push bar on at least one end to provide a surface for enabling a wearer to urge said slide member.

11. The shoe of claim 10, wherein said bore includes a threaded plug for receiving said spike housing, said spike housing having external threads for removably securing said spike housing to said sole.

12. The shoe of claim 11, wherein said shoe includes a ball area which corresponds to the ball portion of a person's foot, and said at least one hollow track is positioned near the ball area of said shoe.

13. The shoe of claim 12, two hollow tracks positioned substantially parallel to each other near the ball area of said shoe.

14. The shoe of claim 13, wherein two bores having corresponding spike housings therein are associated with each of said two hollow tracks, to provide for retraction and extension of four of said retractable spikes in said ball area of shoe.

15. The shoe of claim 14, wherein each end of said slide member is provided with a push bar for actuating said slide member.

16. The shoe of claim 15, wherein said push bars are joined together on each side of said shoe to form joint, elongated push bars which allow for the actuation of both slide members simultaneously.

17. The shoe of claim 1, wherein said bore is further provided with an apertured disc, said apertured disc engaging said bottom of said sole and extending downwardly therefrom.

18. The shoe of claim 17, wherein said apertured disc is made of a rigid plastic material.

19. The shoe of claim 18, wherein said apertured disc is further provided with a plurality of small downwardly-facing projections.

20. The shoe of claim 19, wherein said sole is further provided with a plurality of disc-shaped spikes having a plurality of small downwardly-facing projections spatially arranged in a predetermined fashion about said sole.

21. The shoe of claim 20, wherein said disc-shaped spikes are removably attached to said shoe sole.

22. The shoe of claim 21, wherein said disc-shaped spikes are formed from a durable plastic material.

23. The shoe of claim 1, wherein said shoe includes a fixed spike attached to said sole, having centrally disposed therein said retractable spike, and wherein said retractable spike is slidably mounted in said fixed spike so as to extend and retract through an aperture in said fixed spike.

24. The shoe of claim 1, further comprising a spike housing secured to said sole through said open-ended bore, said spike housing comprising a hollow cylinder in which said retractable spike is housed.

25. The shoe of claim 1, wherein said biasing member is a spring.

26. The shoe of claim 25, wherein said retractable spike includes a head at said first end, and said spring includes a top portion, said retractable spike being positioned centrally through said spring so that said head rests on said top portion of said spring, said ball member resting adjacent said head opposite said spring.

27. The shoe of claim 25, wherein said spring includes a bottom portion, said spring being positioned adjacent said retractable spike so that said bottom portion of said spring contacts said head, said ball member resting on said top portion of said spring.

28. A shoe, comprising:

a sole having at least one bore;

at least one fixed spike secured in said at least one bore, said fixed spike having a housing and an apertured flange member secured to said housing;

a retractable spike slidably disposed within said housing and movable between an extended and retracted position with respect to said housing;

a biasing member within said housing for urging said retractable spike to said retracted position within said housing;

means within said sole for selectively extending said retractable spike from said fixed spike including a slide member operably connected with said retractable spike;

a plurality of traction projections defined on a surface of said apertured flange member; and a ball member disposed between said retractable spike and said slide member.

29. A shoe, comprising:

a sole provided with at least one bore;

at least one fixed spike secured in said at least one bore;

a retractable spike disposed within said at least one fixed spike and adapted to selectively extend in and out of said fixed spike;

means for selectively extending said retractable spike from said fixed spike, said means including a slide member located within said sole; and a ball member interconnecting said retractable spike and said slide member.

30. A shoe comprising:

a sole;

at least one fixed spike secured to said sole;

a retractable spike selectively positionable between a first position extending out of said fixed spike and a second position at least partially retracted within said fixed spike; and a movable member engaging said retractable spike, said movable member operable by a user to positively select said retractable spike between said first and said second positions.

31. A shoe comprising:

a sole having at least one bore;

a threaded plug received in said bore;

at least one fixed spike having external threads and removably secured within said plug, said fixed spike further including a hollow cylinder and an apertured flange member secured to said hollow cylinder, said flange member having a central through aperture and a plurality of traction projections on an exterior surface thereof shaped to improve traction of said sole;

a retractable spike having a tapered lower end, said retractable spike housed within said hollow cylinder of said fixed spike and slidably mounted through said apertured flange member and in said aperture, and selectively positionable between a first position extending out of said fixed spike and a second normal position at least partially retracted within said fixed spike;

means for selectively extending and retracting said retractable spike from said fixed spike including a slide member located within said sole and having at least one surface engaging said retractable spike;

means within said fixed spike biasing said retractable spike in a retracted position; and a ball member disposed between said at least one surface and said retractable spike.

32. A shoe comprising:

a sole having at least one bore;

a threaded plug in said bore;

at least one fixed spike having external threads removably secured within said plug, a central through aperture, and an exterior surface thereof shaped to improve traction of said sole;

a retractable spike housed within said fixed spike and slidably mounted in said aperture, said retractable spike selectively positionable between a first position extending out of said fixed spike and a second normal position at least partially retracted within said fixed spike;

a slide member located within said sole including at least one surface oriented toward said retractable spike for engaging said retractable spike and for selectively extending and retracting said retractable spike from said fixed spike; and a ball member operably connected with said retractable spike.

* * * * *

UNITED STATES PATENT AND TRADEMARK OFFICE

CERTIFICATE OF CORRECTION

PATENT NO. : 5,732,482
DATED : March 31, 1998
INVENTOR(S) : Mark D. Remington et al.

It is certified that error appears in the above-identified patent and that said Letters Patent is hereby corrected as shown below:

Column 3, line 22;
"spike-position" should be –spikes-retracted position--

Column 5, line 10;
"housings, 40" should be --housings 40,--.

Column 7, line 15;
"on spring" should be --or spring--.

Column 9, line 27;
After "bottom" insert --,--.

Column 10, line 22;
After "," insert --wherein said at least one hollow track includes--.

Signed and Sealed this

Fifteenth Day of December, 1998

Bruce Lehman

*Attest:*

BRUCE LEHMAN

*Attesting Officer*

*Commissioner of Patents and Trademarks*